US010492267B2

(12) United States Patent
Elsherbini et al.

(10) Patent No.: US 10,492,267 B2
(45) Date of Patent: Nov. 26, 2019

(54) DISPLAY FOR STRETCHABLE COMPUTING DEVICE

(71) Applicant: Intel Corporation, Santa Clara, CA (US)

(72) Inventors: Adel Elsherbini, Chandler, AZ (US); Sasha Oster, Chandler, AZ (US); Nadine L. Dabby, Palo Alto, CA (US); Aleksandar Aleksov, Chandler, AZ (US); Braxton Lathrop, Lake Oswego, OR (US); Feras Eid, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 797 days.

(21) Appl. No.: 14/866,625

(22) Filed: Sep. 25, 2015

(65) Prior Publication Data

US 2017/0094749 A1 Mar. 30, 2017

(51) Int. Cl.
*H05B 33/26* (2006.01)
*A42B 1/00* (2006.01)
(Continued)

(52) U.S. Cl.
CPC ..... *H05B 33/28* (2013.01); *A41B 1/08* (2013.01); *A41D 1/002* (2013.01); *A42B 1/004* (2013.01);
(Continued)

(58) Field of Classification Search
CPC ..... H05B 33/28; H05B 33/06; G09F 13/22; A41D 1/002; A42B 1/242; A42B 1/004
(Continued)

(56) References Cited

U.S. PATENT DOCUMENTS 6,054,725 A * 4/2000 Liedenbaum ..... H01L 27/3239 257/103
6,551,726 B1 * 4/2003 Burrows ..... H05B 33/04 257/100
(Continued)

FOREIGN PATENT DOCUMENTS

| | | |
|---|---|---|
| JP | 2003532981 A | 11/2003 |
| TW | 201730637 | 9/2017 |
| WO | 2017052933 | 3/2017 |

OTHER PUBLICATIONS

"International Application Serial No. PCT/US2016/048473, International Search Report dated Nov. 28, 2016", 3 pgs.
(Continued)

*Primary Examiner* — Karabi Guharay
(74) *Attorney, Agent, or Firm* — Schwegman Lundberg & Woessner, P.A.

(57) ABSTRACT

Some forms relate to a stretchable computing display device. The stretchable computing display device includes a stretchable base; a patterned conductive section mounted on the stretchable base, wherein the patterned conductive section includes a first portion and a second portion that is electrically isolated from the first portion; an electroluminescent material mounted on the stretchable base such that the electroluminescent material is between the first portion and the second portion of the patterned conductive section; an encapsulant that covers at least a portion of the patterned conductive section; and a textile such that the stretchable base is mounted on the textile, wherein the textile is part of a garment.

10 Claims, 6 Drawing Sheets

(51) Int. Cl.

| | |
|---|---|
| ***A41D 1/00*** | (2018.01) |
| ***H05B 33/06*** | (2006.01) |
| ***H05B 33/28*** | (2006.01) |
| ***A41B 1/08*** | (2006.01) |
| ***F21V 33/00*** | (2006.01) |
| ***H05B 33/04*** | (2006.01) |
| ***A42B 1/24*** | (2006.01) |

(52) U.S. Cl.
CPC ..... *A42B 1/242* (2013.01); *F21V 33/0008* (2013.01); *H05B 33/04* (2013.01); *H05B 33/06* (2013.01)

(58) Field of Classification Search
USPC ..... 362/103, 106
See application file for complete search history.

(56) References Cited

U.S. PATENT DOCUMENTS

| | | | | |
|---|---|---|---|---|
| 6,998,774 | B1 | 2/2006 | Barnardo et al. | |
| 8,952,610 | B2 * | 2/2015 | Rabe | D06M 15/63 313/509 |
| 2001/0043164 | A1 * | 11/2001 | Thagard | A41D 27/085 345/7 |
| 2006/0132028 | A1 | 6/2006 | Anderson | |
| 2007/0090758 | A1 | 4/2007 | Kwasny et al. | |
| 2010/0003496 | A1 | 1/2010 | Dias et al. | |
| 2013/0055602 | A1 * | 3/2013 | Wright, Jr. | G09F 9/301 40/544 |

OTHER PUBLICATIONS

"International Application Serial No. PCT/US2016/048473, Written Opinion dated Nov. 28, 2016", 11 pgs.

"International Application Serial No. PCT US2016 048473, International Preliminary Report on Patentability dated Apr. 5, 2018", 13 pgs.

* cited by examiner

DISPLAY FOR STRETCHABLE COMPUTING DEVICE

TECHNICAL FIELD

Embodiments described herein generally relate to a computing device, and more particularly to a display for a stretchable computing display device.

BACKGROUND

Conventional wearable computing applications typically use stand-alone rigid devices (e.g., smart watches or glasses), or rigid bulky packs that snap into a connector on a garment or belt. Other types of applications use flexible/conformable patches in which a battery and sensors are integrated into a patch that is then adhesively bonded to the skin. As examples, healthcare and fitness applications may utilize such computing devices.

One class of wearable computing devices that is rising in importance relates to textiles which include integrated electronic devices. More recent applications try to create "smart" garments that seamlessly integrate electronics into a garment that is able to be washed multiple times (e.g., by a washing machine).

There are many "smart" garments where it may be desirable to have light displays, indicators or screens on the fabric. As examples, displays may be used to provide feedback to the user about his/her exercise status or to provide other information in different usage scenarios.

One potential method of implementing displays into "smart" garments includes using discrete LEDs. Some of the drawbacks with using LEDs are that they are relatively large and may cause noticeable bulk in the fabric which may result in discomfort to a wearer of a "smart" garment.

Another potential method of implementing displays into "smart" garments includes using flexible OLED displays. Some of the drawbacks with using OLEDs are that they (i) require a significant amount of power; (ii) are relatively expensive; and/or (iii) are more complex than the displays that are typically required for some wearable applications.

Therefore, a need exists for stretchable computing devices that may integrate various displays directly into a textile or some other stretchable medium. The stretchable computing devices should integrate a display directly into a textile without (i) adding to the discomfort of wearing the textile; (ii) adding significant cost to manufacturing the textile; and/or (iii) requiring a significant amount of added power to operate the display.

DESCRIPTION OF EMBODIMENTS

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Orientation terminology, such as "horizontal," as used in this application is defined with respect to a plane parallel to the conventional plane or surface of a wafer or substrate, regardless of the orientation of the wafer or substrate. The term "vertical" refers to a direction perpendicular to the horizontal as defined above. Prepositions, such as "on," "side" (as in "sidewall"), "higher," "lower," "over," and "under" are defined with respect to the conventional plane or surface being on the top surface of the wafer or substrate, regardless of the orientation of the wafer or substrate.

As used herein "stretchable" refers to the ability to elongate in the direction of an applied force. The amount of stretching will be determined in part based on the application where any of the example methods described herein are to be used. As an example, the degree of stretching may be different when the example stretchable computing devices described herein are integrated with (or detachably connected to) textiles (e.g., clothing) as opposed to when the example stretchable computing display devices described herein are attached directly to the skin of someone that utilizes any of the example stretchable computing display devices.

Figure 1:
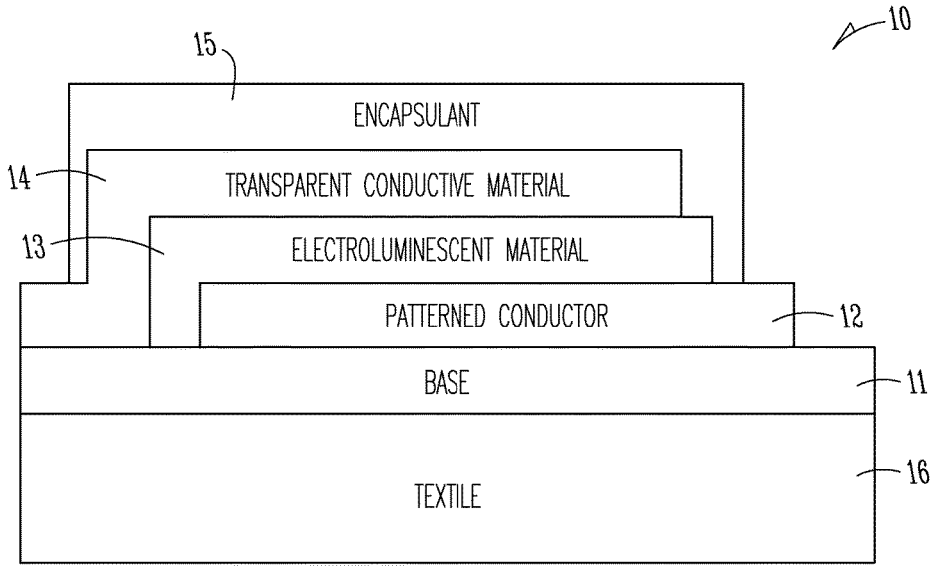
FIG. 1 is a schematic side view illustrating an example stretchable computing display device.
Figure 2:
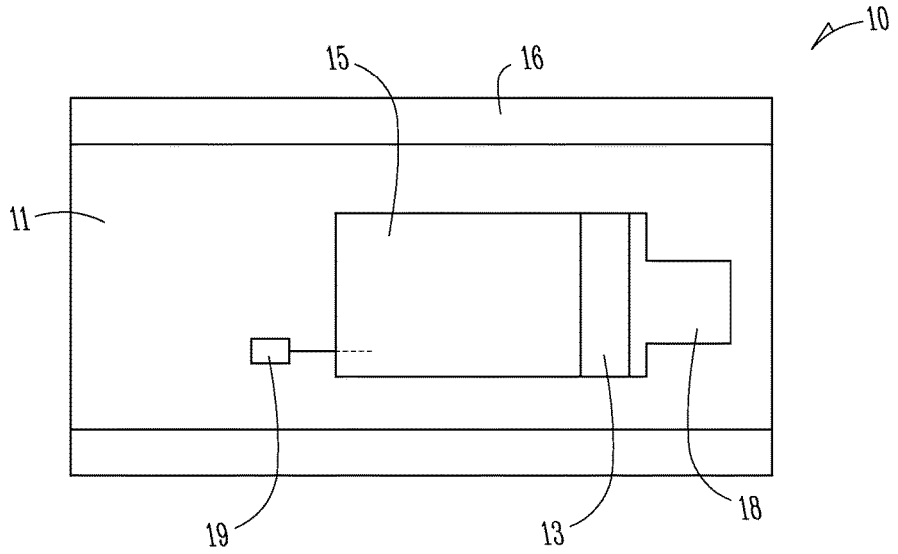
FIG. 2 is a top view of the example stretchable computing display device shown in FIG. 1.

FIG. 1 is a schematic side view illustrating an example stretchable computing display device 10. FIG. 2 is a top view of the example stretchable computing display device 10 shown in FIG. 1.

The example stretchable computing display devices described herein may create electroluminescent displays that integrate electroluminescent materials with waterproof flexible encapsulants. The use of electroluminescent materials may permit the high volume manufacturing processes to be used to fabricate the example stretchable computing display devices. The disclosed stretchable computing display devices may be flexible, washable and very thin which may facilitate their incorporation into textiles.

The stretchable computing display device 10 includes a stretchable base 11 and a patterned conductor 12 mounted on the base 11. An electroluminescent material 13 is mounted on the patterned conductor 12 and a transparent conductive material 14 is mounted on the electroluminescent material 13. The electroluminescent material 13 is between the patterned conductor 12 and the transparent conductive material 14. The electroluminescent material 13 electrically isolates the patterned conductor 12 from the transparent conductive material 14. The electroluminescent material 13 is electrically connected to some device that provides electrical power and/or signals to the stretchable computing display device 10.

An encapsulant 15 covers at least a portion of each of the patterned conductor 12, the electroluminescent material 13 and the transparent conductive material 14. It should be noted that the encapsulant 15 may be partially, or fully, transparent. In addition, the type of encapsulant 15 that is included in the stretchable computing display device 10 will depend in part on the application where the stretchable computing display device 10 is to be used as well as the manufacturing considerations that are associated with fabricating the stretchable computing display device 10 (among other factors).

The stretchable computing display device 10 may further include a textile 16 such that the stretchable base 11 is mounted on the textile 16 (or some other part of the stretchable computing display device 10). The type of textile 16 that is included in the stretchable computing display device 10 will depend in part on (i) the application where the stretchable computing display device 10 is to be used; (ii) the type of material that is used for the stretchable base 11; and/or (iii) the manufacturing processes that are associated with fabricating the stretchable computing display device 10 (among other factors).

Figure 3:
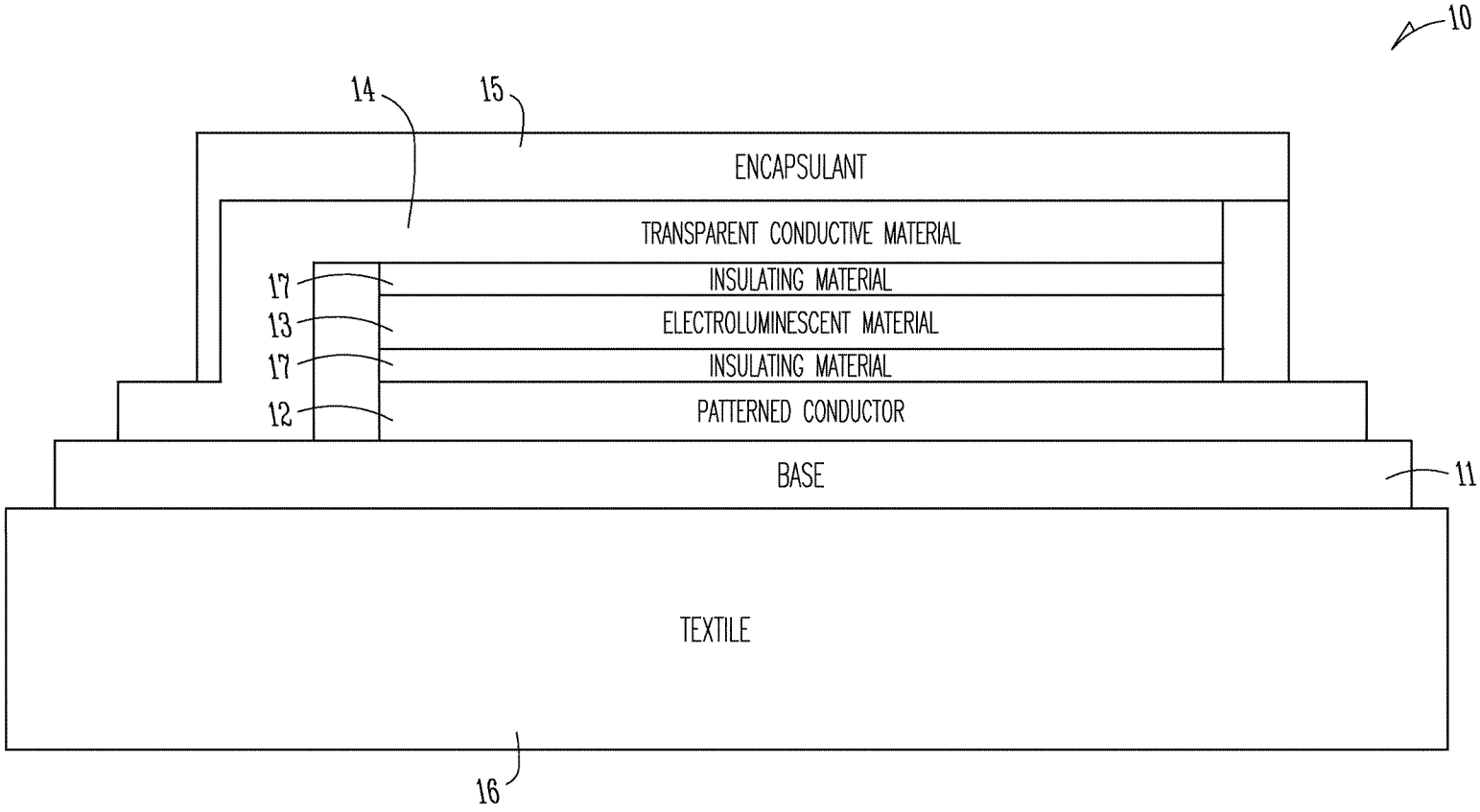
FIG. 3 is a schematic side view of the example stretchable computing display device shown in FIG. 1 with an additional insulating material added to the example stretchable computing display device.

As shown in FIG. 3, the stretchable computing display device 10 may further include at least one additional insulating material 17 (e.g., two layers of additional insulating material are shown in FIG. 3). The additional insulating material 17 is between the patterned conductor 12 and the transparent conductive material 14. The additional insulating material 17 electrically isolates the patterned conductor 12 from the transparent conductive material 14.

It should be noted that the number and type of additional insulating materials will depend in part on the overall configuration of the stretchable computing display device 10. In addition, the additional insulating materials 17 may be the same, or different, materials. As an example, the upper insulating materials 17 may be transparent while the lower insulating materials 17 are not transparent.

As shown in FIG. 1, the patterned conductor 12 may include at least one pad 18. In addition, the transparent conductive material 14 may include at least one pad 19. The at least one pads 18, 19 may be used to deliver at least one of power and signals to the patterned conductor 12 and/or the transparent conductive material 14. The number, type and size of the pads 18, 19 will depend in part on the overall configuration of the stretchable computing display device 10.

In some forms, the patterned conductor 12 may be patterned conductive ink and the transparent conductive material 14 may be transparent conductive ink. The patterned conductive ink and the transparent conductive ink as well as the electroluminescent material may be patterned onto the stretchable computing display device using any printing or depositing processes that are known now, or discovered in the future (e.g., screen printing, 3D printing and/or slit coating among others). In addition, the patterned conductor 12 and the transparent conductive material 14 may be placed on the stretchable computing display device 10 in one or more layers and may be sandwiched between dielectric layers (which may also be screen printed).

The encapsulant 15 may be laminated, screen printed or slit coated (among other types of processes) on to the stretchable computing display device 10 to provide protection to the various components. The pads 18, 19 may then be exposed for electrical connection to other electronic components that provide power and/or signals to the stretchable computing display device 10.

The stretchable base 11 may be formed of a variety of different types of materials. The type of material that is used for the stretchable base 11 will depend in part on the application where the stretchable computing display device 10 is to be used as well as where the stretchable computing display device 10 is to be mounted. Some example materials for the stretchable base 11 include, but are not limited to, Poly-Di-Methyl-Siloxane (PDMS) and other silicone-based elastomers, Thermo-Plastic-Polyurethane elastomers (TPUs), butyl rubber and other elastomer and elastomer-like materials (among other materials).

In some forms, the stretchable computing display device 10 may include a bottom encapsulant 15 that may be mounted (e.g., laminated) onto a textile (e.g., a fabric). The encapsulant 15 may provide protection from the environment and water resistance. In addition depending on the thickness of the encapsulant 15, the encapsulant 15 may prevent creasing in the various components that form the stretchable computing display device 10.

Figure 4:
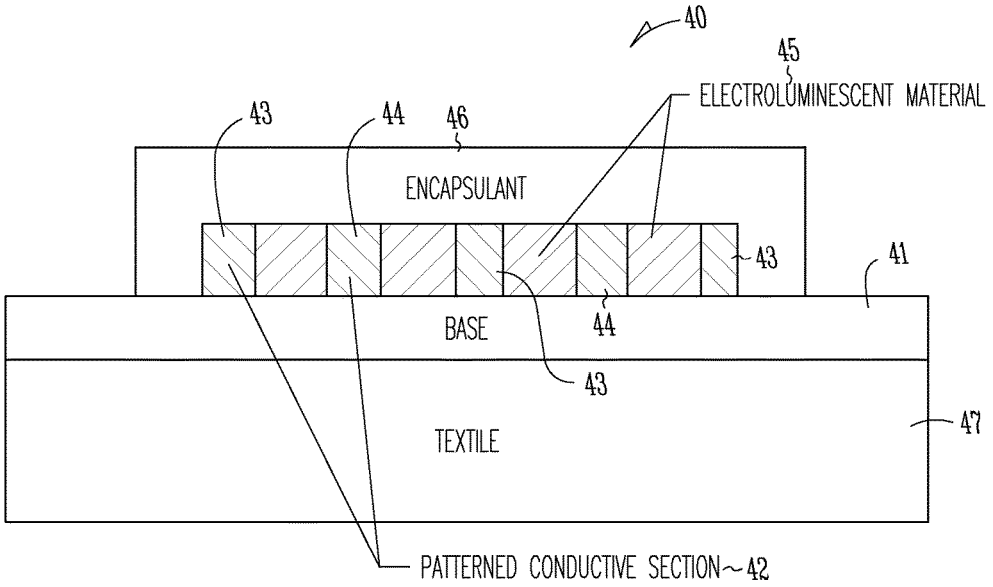
FIG. 4 is a schematic side view illustrating another example stretchable computing display device.
Figure 5:
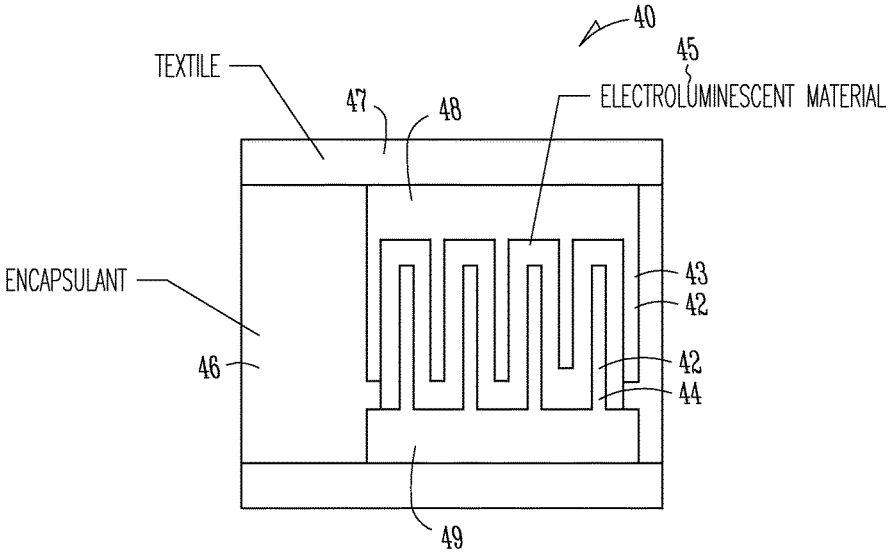
FIG. 5 is a top view of the example stretchable computing display device shown in FIG. 4.

FIG. 4 is a schematic side view illustrating another example stretchable computing display device 40. FIG. 5 is a top view of the example stretchable computing display device 40 shown in FIG. 4.

The stretchable computing display device 40 includes a stretchable base 41 and a patterned conductive section 42 mounted on the stretchable base 41. The patterned conductive section 42 includes a first portion 43 and a second portion 44 that is electrically isolated from the first portion 43 (shown more clearly in FIG. 5).

An electroluminescent material 45 is mounted on the stretchable base 41. The electroluminescent material 45 is between the first portion 43 and the second portion 44 of the patterned conductive section 42.

An encapsulant 46 covers at least a portion of the patterned conductive section 42. It should be noted that the encapsulant 46 may be partially, or fully, transparent. In addition, the amount, type and size of the encapsulant 46 will depend in part on the overall configuration of the components that make up the stretchable computing display device 40 (among other factors).

In the example form that is illustrated in FIG. 5, the electroluminescent material 45 has a square wave shape. It should be noted that many shapes and sizes are contemplated for the electroluminescent material 45. As examples, the electroluminescent material 45 may be interdigitated and/or have a modified sinusoidal shape. It should be noted that the electroluminescent material 45 may have any shape that is known now, or discovered in the future.

The stretchable computing display device 40 may further include a textile 47. The stretchable base 41 may be mounted on the textile 47. The type of textile 47 that is included in the stretchable computing display device 40 will depend in part on the application where the stretchable computing display device 40 is to be used as well as the manufacturing processes that are associated with fabricating the stretchable computing display device 40 (among many other factors).

In some forms, the first portion 43 includes at least one pad 48 that is used to deliver at least one of power and/or signals to the first portion 43. In addition, the second portion 44 may include at least one pad 49 that is used to deliver at least one of power and/or signals to the second portion 44. The number, type and size of pads 48, 49 that are included in the stretchable computing display device 40 will depend in part on the application where the stretchable computing display device 40 is to be used as well as the overall configuration of the stretchable computing display device 40.

As discussed above, the patterned conductive section 42 may be patterned conductive ink and the electroluminescent material 45 may also be a patterned ink. It should be noted that the patterned conductive section 42 and the electroluminescent material 45 may be mounted on the stretchable base 41 in any manner that is known now, or discovered in the future (e.g., screen printing).

It should be noted that the stretchable base 41 may be any type of material. As discussed above, the type of stretchable base 41 that is included in the stretchable computing display device 40 will depend in part on the application where the stretchable computing display device 40 is to be used as well as the type of textile 47 with which the stretchable computing display device 40 is to be incorporated (among other factors).

It should be noted that in the stretchable computing display devices 10, 40 described herein, any of the patterned conductive sections, electroluminescent materials and transparent conductive materials may be made stretchable by forming these components in meanders (e.g., a modified square wave or sinusoidal shape). In order to ensure reliability, thicker encapsulants 15, 46 may be included in the stretchable computing display devices 10, 40 to prevent the stretchable computing display devices 10, 40 from failing due to mechanical stresses.

The stretchable computing display devices 10, 40 may provide one or more advantages to conventional displays (e.g., OLED displays). As examples, the stretchable computing display devices 10, 40 may (i) lower overall costs for comparable display sizes; (ii) utilize screen printing techniques that are compatible with equipment in the textile industry; (iii) readily utilize encapsulants that may make the stretchable computing display devices waterproof; (iv) permit the use of relatively simple circuitry to create different patterns; and (v) permit low cost and parallel integration of multiple displays into different parts of a textile (e.g., clothing).

Figure 6:
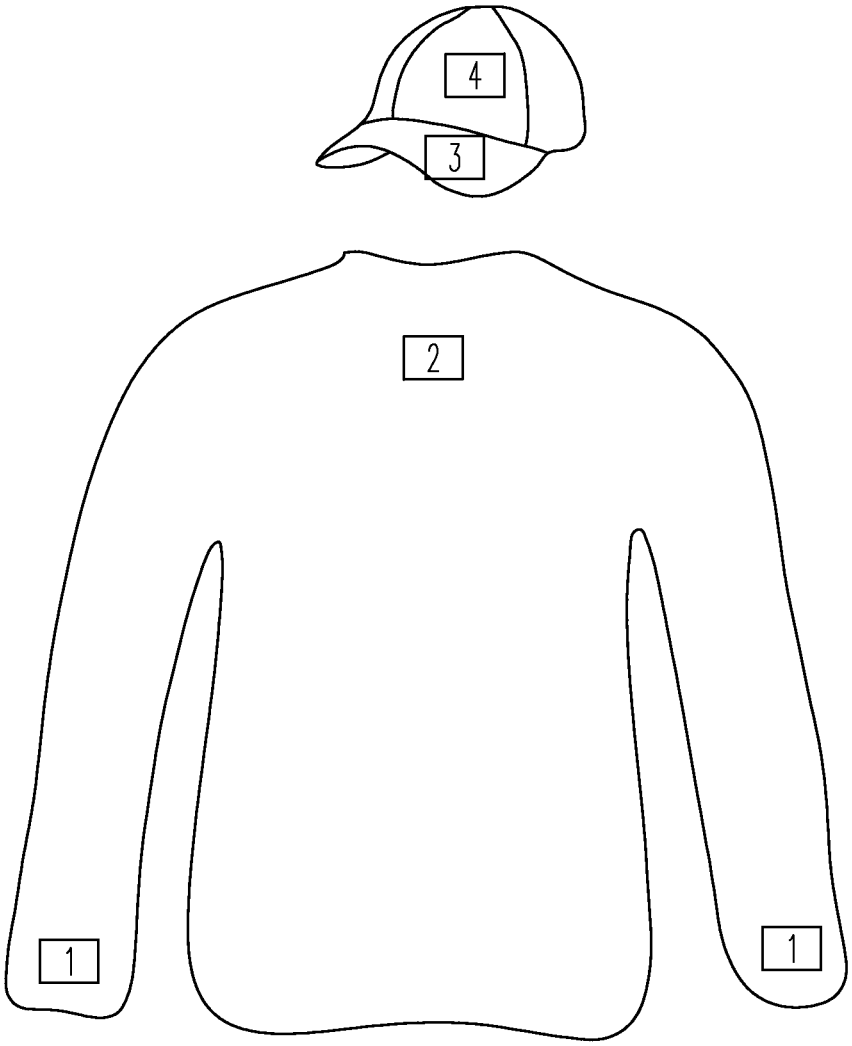
FIG. 6 is a schematic front view illustrating where the stretchable computing display devices described herein may be located on different example textiles.

The stretchable computing devices 10, 40 that are described herein may be utilized in any application that is known now, or discovered in the future. FIG. 6 is a schematic front view illustrating just a few of the locations where the stretchable computing display devices 10, 40 may be located on different example textiles.

Figure 7:
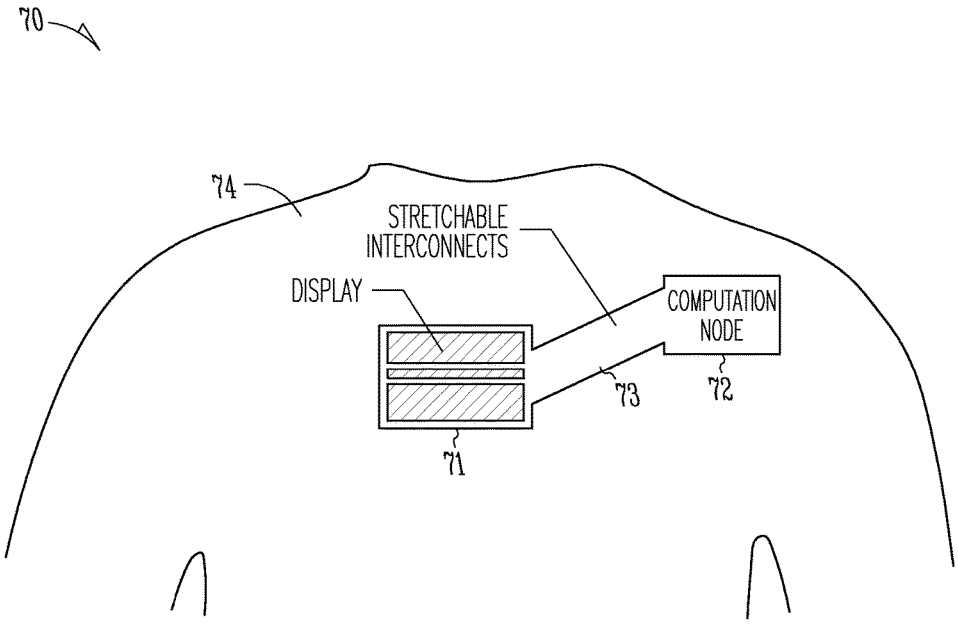
FIG. 7 shows an example stretchable computing display device incorporated into an example textile.

FIG. 7 shows an example stretchable computing display device 70 incorporated into an example textile 74. The stretchable computing display device includes a computation node 72 that is mounted in any manner that is known now, or discovered in the future, to the textile 74. The computation node 72 provides signals and/or power to a display 71 (which may be similar to the stretchable computing devices 10, 40 described herein). The display 71 may be connected to the computation node 72 by stretchable interconnects 73. The stretchable interconnect 73 may take a variety of forms, including but not limited to, meandering conductors. In some forms, the meandering conductors may have a modified sinusoidal shape (among other types of configurations).

Figure 8:
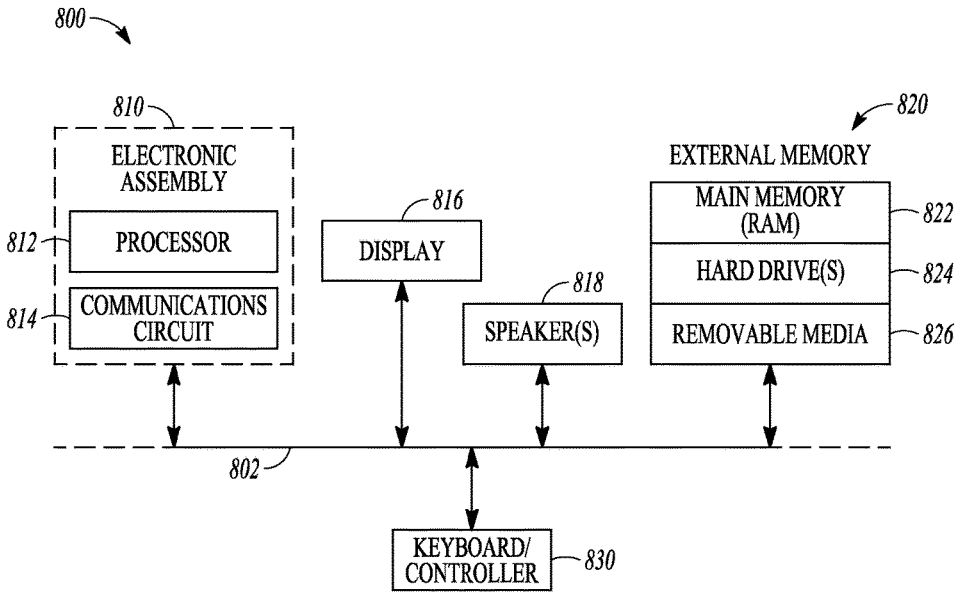
FIG. 8 is block diagram of an electronic apparatus that includes the stretchable computing display devices described herein.

FIG. 8 is a block diagram of an electronic apparatus 800 incorporating at least one stretchable computing display device 10, 40 described herein. Electronic apparatus 800 is merely one example of an electronic apparatus in which forms of the stretchable computing display devices 10, 40 described herein may be used. Examples of an electronic apparatus 800 include, but are not limited to, personal computers, tablet computers, mobile telephones, game devices, MP3 or other digital media players, etc. In this example, electronic apparatus 800 comprises a data processing system that includes a system bus 802 to couple the various components of the electronic apparatus 800. System bus 802 provides communications links among the various components of the electronic apparatus 800 and may be implemented as a single bus, as a combination of busses, or in any other suitable manner.

An electronic apparatus 800 as describe herein may be coupled to system bus 802. The electronic apparatus 800 may include any circuit or combination of circuits. In one embodiment, the electronic apparatus 800 includes a processor 812 which can be of any type. As used herein, "processor" means any type of computational circuit, such as but not limited to a microprocessor, a microcontroller, a complex instruction set computing (CISC) microprocessor, a reduced instruction set computing (RISC) microprocessor, a very long instruction word (VLIW) microprocessor, a graphics processor, a digital signal processor (DSP), multiple core processor, or any other type of processor or processing circuit.

Other types of circuits that may be included in electronic apparatus 800 are a custom circuit, an application-specific integrated circuit (ASIC), or the like, such as, for example, one or more circuits (such as a communications circuit 814) for use in wireless devices like mobile telephones, tablet computers, laptop computers, two-way radios, and similar electronic systems. The IC can perform any other type of function.

The electronic apparatus 800 may also include an external memory 820, which in turn may include one or more memory elements suitable to the particular application, such as a main memory 822 in the form of random access memory (RAM), one or more hard drives 824, and/or one or more drives that handle removable media 826 such as compact disks (CD), flash memory cards, digital video disk (DVD), and the like.

The electronic apparatus 800 may also include a display device 816, one or more speakers 818, and a keyboard and/or controller 830, which can include a mouse, trackball, touch pad, voice-recognition device, or any other device that permits a system user to input information into and receive information from the electronic apparatus 800.

To better illustrate the stretchable computing display devices 10, 40 disclosed herein, a non-limiting list of examples is provided herein:

Example 1 includes a stretchable computing display device. The stretchable computing display device includes a stretchable base; a patterned conductor mounted on the base; an electroluminescent material mounted on the patterned conductor; a transparent conductive material mounted on the electroluminescent material such that the electroluminescent material is between the patterned conductor and the transparent conductive material, wherein the electroluminescent material electrically isolates the patterned conductor from the transparent conductive material; and an encapsulant that covers at least a portion of each of the patterned conductor, the electroluminescent material and the transparent conductive material.

Example 2 includes the stretchable computing display device of example 1, and further including a textile such that the stretchable base is mounted on the textile.

Example 3 includes the stretchable computing display device of any one of examples 1-2, and further including at least one additional insulating material between the patterned conductor and the transparent conductive material, wherein the additional insulating material electrically isolates the patterned conductor from the transparent conductive material.

Example 4 includes the stretchable computing display device of any one of examples 1-3, wherein the patterned conductor includes at least one pad that is used to deliver at least one of power and signals to the patterned conductor.

Example 5 includes the stretchable computing display device of examples 1-4, wherein the transparent conductive material includes at least one pad that is used to deliver at least one of power and signals to the transparent conductive material.

Example 6 includes the stretchable computing display device of any one of examples 1-5, wherein the patterned conductor is patterned conductive ink, and wherein the transparent conductive material is the transparent conductive ink.

Example 7 includes the stretchable computing display device of any one of examples 1-6, wherein the stretchable base is formed of an elastomer.

Example 8 includes a stretchable computing display device. The stretchable computing display device includes a stretchable base; a patterned conductive section mounted on the stretchable base layer, wherein the patterned conductive section includes a first portion and a second portion that is electrically isolated from the first portion; an electroluminescent material mounted on the stretchable base such that the electroluminescent material is between the first portion and the second portion of the patterned conductive section; and an encapsulant that covers at least a portion of the patterned conductive section.

Example 9 includes the stretchable computing display device of example 8, wherein the electroluminescent material has a square wave shape.

Example 10 includes the stretchable computing display device of any one of examples 8-9, and further including a textile such that the stretchable base is mounted on the textile.

Example 11 includes the stretchable computing display device of any one of examples 8-10, wherein the first portion includes at least one pad 48 that is used to deliver at least one of power and signals to the first portion, and the second portion includes at least one pad 49 that is used to deliver at least one of power and signals to the second portion.

Example 12 includes the stretchable computing display device of any one of examples 8-11, wherein the patterned conductive section is patterned conductive ink.

Example 13 includes the stretchable computing display device of examples 8-12, wherein the electroluminescent material is electroluminescent conductive ink.

Example 14 includes the stretchable computing display device of examples 8-13, wherein the stretchable base layer is an elastomer.

Example 15 includes a stretchable computing display device. The stretchable computing display device includes a stretchable base; a patterned conductor mounted on the stretchable base; an electroluminescent material mounted on the patterned conductor; a transparent conductive material mounted on the electroluminescent material such that the electroluminescent material is between the patterned conductor and the transparent conductive material, wherein the electroluminescent material electrically isolates the patterned conductor from the transparent conductive material; an encapsulant that covers at least a portion of each of the patterned conductor, the electroluminescent material and the transparent conductive material; and a textile such that the stretchable base is mounted on the textile, wherein the textile is part of a garment Example 16 includes the stretchable computing display device of example 15, wherein the garment is a shirt.

Example 17 includes the stretchable computing display device of any one of examples 15-16, wherein the garment is a hat.

Example 18 includes a stretchable computing display device. The stretchable computing display device includes a stretchable base; a patterned conductive section mounted on the stretchable base, wherein the patterned conductive section includes a first portion and a second portion that is electrically isolated from the first portion; an electroluminescent material mounted on the stretchable base such that the electroluminescent material is between the first portion and the second portion of the patterned conductive section; an encapsulant that covers at least a portion of the patterned conductive section; and a textile such that the stretchable base is mounted on the textile, wherein the textile is part of a garment.

Example 19 includes the stretchable computing display device of example 18, wherein the garment is a shirt.

Example 20 includes the stretchable computing display device of any of examples 18-19, wherein the garment is a hat.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description.

The Abstract is provided to comply with 37 C.F.R. § 1.72(b), to allow the reader to quickly ascertain the nature of the technical disclosure. It is submitted with the understanding that it will not be used to interpret or limit the scope or meaning of the claims.

Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A stretchable computing display device, comprising:

a stretchable base;

a patterned conductive layer mounted on the stretchable base, wherein the patterned conductive layer includes a first portion having an upper surface and a lower surface, and a second portion having an upper surface and a lower surface, the second portion being electrically isolated from the first portion;

an electroluminescent material having an upper surface and a lower surface, the electroluminescent material being mounted on the stretchable base such that the electroluminescent material is between the first portion and the second portion of the patterned conductive section, wherein the upper surface of first portion is aligned with the upper surface of the second portion and the upper surface of the electroluminescent material, and the lower surface of the first portion is aligned with the lower surface of the second portion and the lower surface of the electroluminescent material; and an encapsulant that covers at least a portion of the patterned conductive section.

2. The stretchable computing display device of claim 1, wherein the electroluminescent material has a square wave shape.

3. The stretchable computing display device of claim 1, further comprising a textile such that the stretchable base is mounted on the textile.

4. The stretchable computing display device of claim 1, wherein the first portion includes at least one pad that is used to deliver at least one of power and signals to the first portion, and the second portion includes at least one pad that is used to deliver at least one of power and signals to the second portion.

5. The stretchable computing display device of claim 1, wherein the patterned conductive section is patterned conductive ink.

6. The stretchable computing display device of claim 1, wherein the electroluminescent material is an electroluminescent ink.

7. The stretchable computing display device of claim 1, wherein the stretchable base is an elastomer.

8. A stretchable computing device, comprising:

a stretchable base;

a patterned conductive layer mounted on the stretchable base, wherein the patterned conductive layer includes a first portion having an upper surface and a lower surface, and a second portion having an upper surface and a lower surface, the second portion being electrically isolated from the first portion;

an electroluminescent material having an upper surface and a lower surface, the electroluminescent material being mounted on the stretchable base such that the electroluminescent material is between the first portion and the second portion of the patterned conductive section, wherein the upper surface of first portion is aligned with the upper surface of the second portion and the upper surface of the electroluminescent material, and the lower surface of the first portion is aligned with the lower surface of the second portion and the lower surface of the electroluminescent material;

an encapsulant that covers at least a portion of the patterned conductive section; and a textile such that the stretchable base is mounted on the textile, wherein the textile is part of a garment.

9. The stretchable computing display device of claim 8, wherein the garment is a shirt.

10. The stretchable computing display device of claim 8, wherein the garment is a hat.

* * * * *